United States Patent [19]

Faux, Sr. et al.

[11] 4,264,946

[45] Apr. 28, 1981

[54] ELECTRIC LIGHT FIXTURE

[75] Inventors: Kenneth R. Faux, Sr., Mequon; Donald J. Zach, Greendale, both of Wis.

[73] Assignee: Phoenix Products Company, Inc., Milwaukee, Wis.

[21] Appl. No.: 42,005

[22] Filed: May 24, 1979

[51] Int. Cl.[3] ..... F21S 3/00

[52] U.S. Cl. ..... 362/217; 362/368

[58] Field of Search ..... 362/164, 165, 217, 222, 362/223, 225, 368, 370, 371, 396, 437–439

[56] References Cited

U.S. PATENT DOCUMENTS

| | | | |
|---|---|---|---|
| 2,902,591 | 9/1959 | Lipscomb | 362/217 |
| 3,302,017 | 1/1967 | Hanson et al. | 362/368 |
| 3,833,801 | 9/1974 | Trevithick | 362/222 |
| 3,906,217 | 9/1975 | Lackore | 362/396 |
| 4,042,819 | 8/1977 | Dacal . | |
| 4,069,415 | 1/1978 | Dacal . | |
| 4,092,706 | 5/1978 | Vest | 362/223 |
| 4,156,893 | 5/1979 | Baake | 362/222 |
| 4,167,033 | 9/1979 | Fletcher | 362/368 |
| 4,173,037 | 10/1979 | Henderson, Jr. et al. | 362/368 |

OTHER PUBLICATIONS

Control Products, Inc., Bulletin #4030–2.
McJunnkin Corp., Model 100/64 HO Luminare.
Mine Safety Appliances Co., Model LX2400 Brochure.
Ensign Electric Division Mine Illumination.

*Primary Examiner*—Peter A. Nelson
*Attorney, Agent, or Firm*—Quarles & Brady

[57] ABSTRACT

An electrical light fixture comprising a housing (12), a lamp assembly (11) within the housing, and a protective cage (13) surrounding the housing. The protective cage can be formed with a pair of cage elements (14, 15) joined together, and the lamp assembly can have a slip-fit engagement with the housing through an open end thereof.

8 Claims, 5 Drawing Figures

46
47
12
37
47
10
62
49
57
45
28
23
36b
50
13
54
27
56
31
33
62
48

46
14
51
47
45
42
54
12
37

42
20
36
19
42
17
11
32
16
22
21
49
53
28
51
52
27
54
23
55
31
30
33
62
25
15
57
50
48
54
51
56
62

5
5
40
45
41
59
42
36
47
58
30
43
37
61
29
23
24
28
26
27
25
21
32
43
19
20
34
38
35
42
39
46
18
22
16
22a
17
43
31
50
48
43
42
42
49

46
32
37
35
62
49
60
22a
16

37
47
51
50
45
52
48
62
36a
27
54
25
23
31
33
28
51
36b

ELECTRIC LIGHT FIXTURE

TECHNICAL FIELD

This invention relates to electric light fixtures, particularly explosion-proof light fixtures.

Background Art

Various machines which are used in coal mines require light fixtures in order to illuminate the mine area so that the workmen can safely work within the mine. These machines include continuous mining machines, roof bolters, bottom cutters, loaders, drills, etc. The mine Safety Health Administration (MSHA), the successor to the Mining Enforcement and Safety Administration (MESA), has established illumination standards specifying the light levels to be obtained by light fixtures used on mining equipment. MSHA has also established standards which light fixtures, and other equipment, must meet in order to be used safely underground, particularly in the gassy mines wherein the presence of methane gas causes a safety problem with respect to the danger of explosions; these standards are included in the so-called Schedule 2G initially promulgated by the Bureau of Mines under date of Mar. 19, 1968.

One of the objects of our present invention is to provide an electric light fixture which can meet the safety standards established by the applicable federal regulations. Such fixtures are available commercially and disclosed in the patent art, see e.g. U.S. Pat. Nos. 4,042,819 and 4,069,415 but we sought to develop an improved fixture in comparison to the known fixtures of this general type.

Disclosure of the Invention

Briefly, our present invention comprises an electric light fixture which combines a lamp assembly, a housing for the lamp assembly, and a protective cage which is positioned about the housing. The protective cage surrounding the housing is formed of two elements which can be readily joined together in order to facilitate relamping of the light fixture while providing effective protection against damage. The lamp assembly includes a lamp and associated elements mounted on a support member in such fashion that the complete assembly can be removed from the fixture when relamping is necessary. In a particularly effective form of the housing, a light transmitting element which surrounds the lamp assembly is joined to end members of the housing without any machining of the ends of the light-transmitting element.

Further important objects of our invention are: to provide an electric light fixture which can be relamped in a very short time; to provide a light fixture in which the lamp is part of an integral assembly that can be easily removed from the fixture; to provide a light fixture in which machining of a glass or plastic light-transmitting housing that surrounds the lamp is not required; and to devise an outer or protective cage as part of a light fixture that can provide effective protection of the lamp elements and yet be readily removed in order to facilitate relamping. A more specific object of our invention is to provide the particular structural details as set forth in the claims which follow.

BEST MODES FOR CARRYING OUT THE INVENTION

Figure 1:
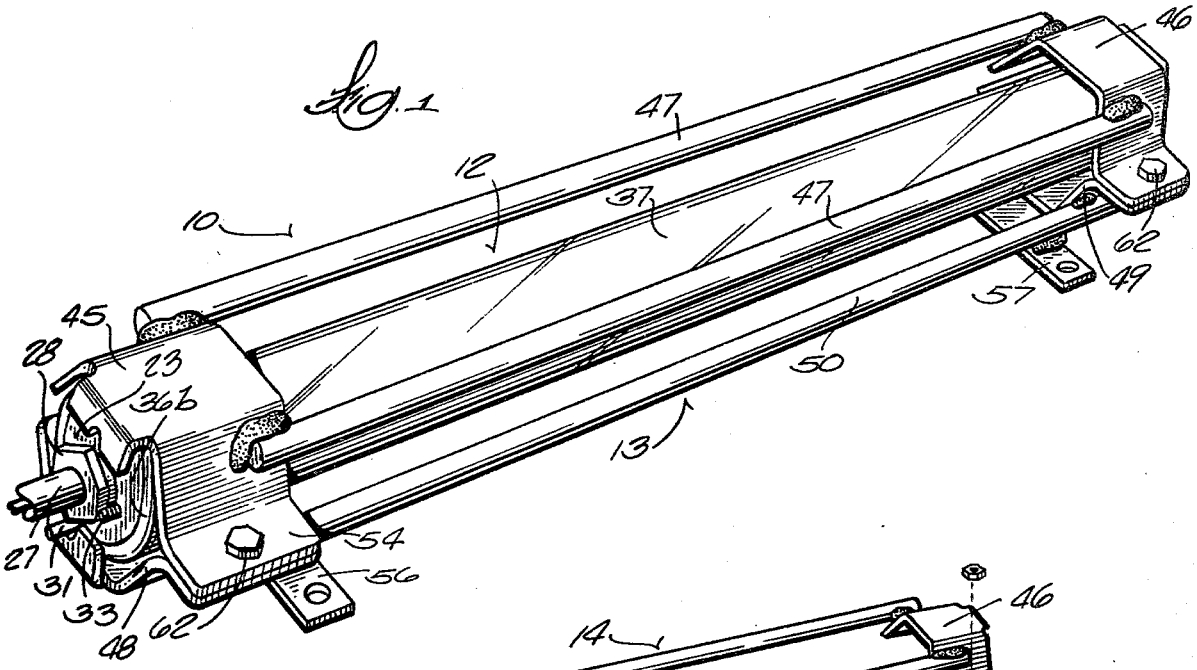
FIG. 1 is a perspective view of an electric light fixture of the present invention.
Figure 2:
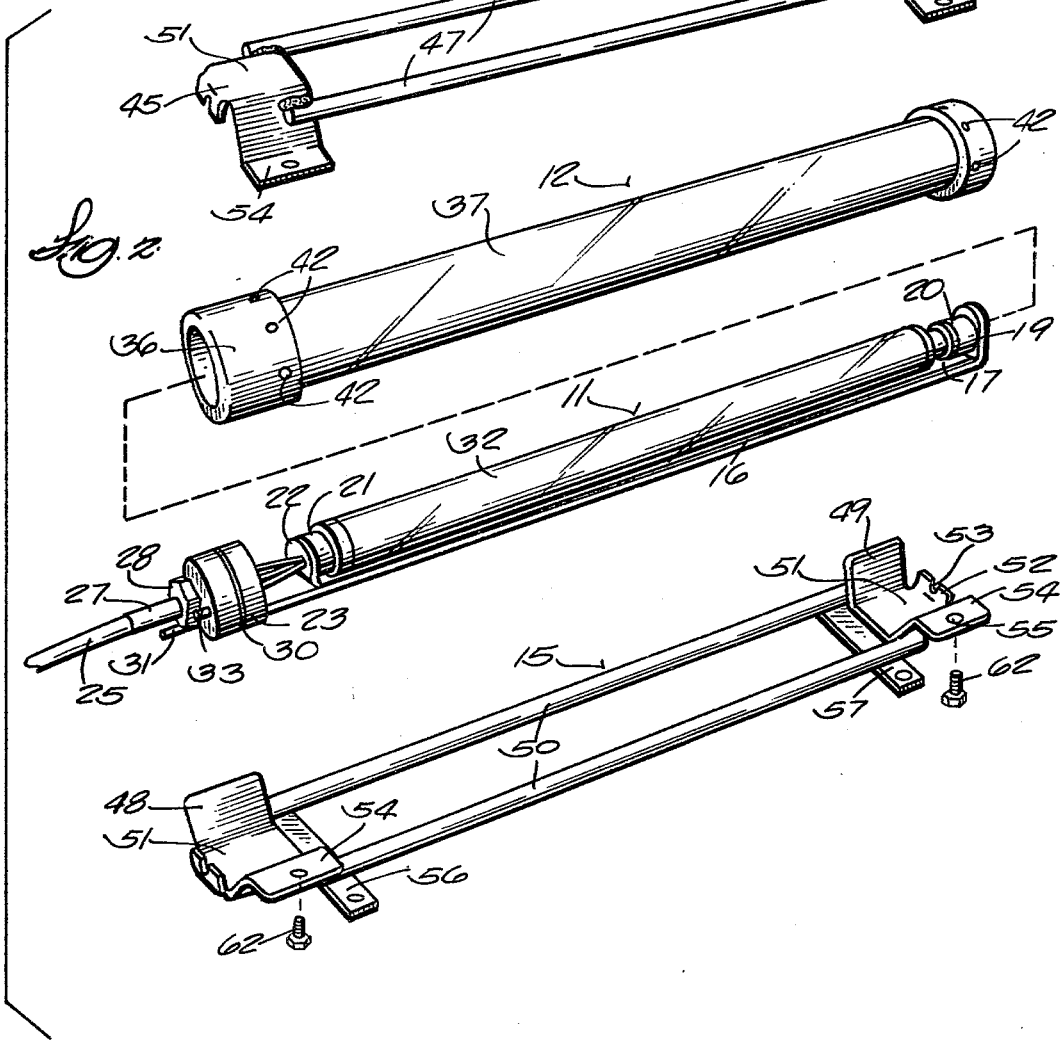
FIG. 2 is an exploded isometric view of the light fixture of FIG. 1.

As indicated in the perspective view of FIG. 1 and exploded view of FIG. 2, the principal elements of the electric light fixture 10 of the present invention comprise: a lamp assembly 11, a housing 12 surrounding the lamp assembly, and a protective cage 13 which surrounds the housing 12. The cage 13 includes first and second cage elements 14 and 15 respectively. In the assembled condition, the lamp assembly 11 fits inside the housing 12 and the protective cage 13 fits about the housing of guard the housing against damage. Each of the principal elements is described separately in sections (a)–(c) below.

(a) Lamp Assembly

Figure 3:
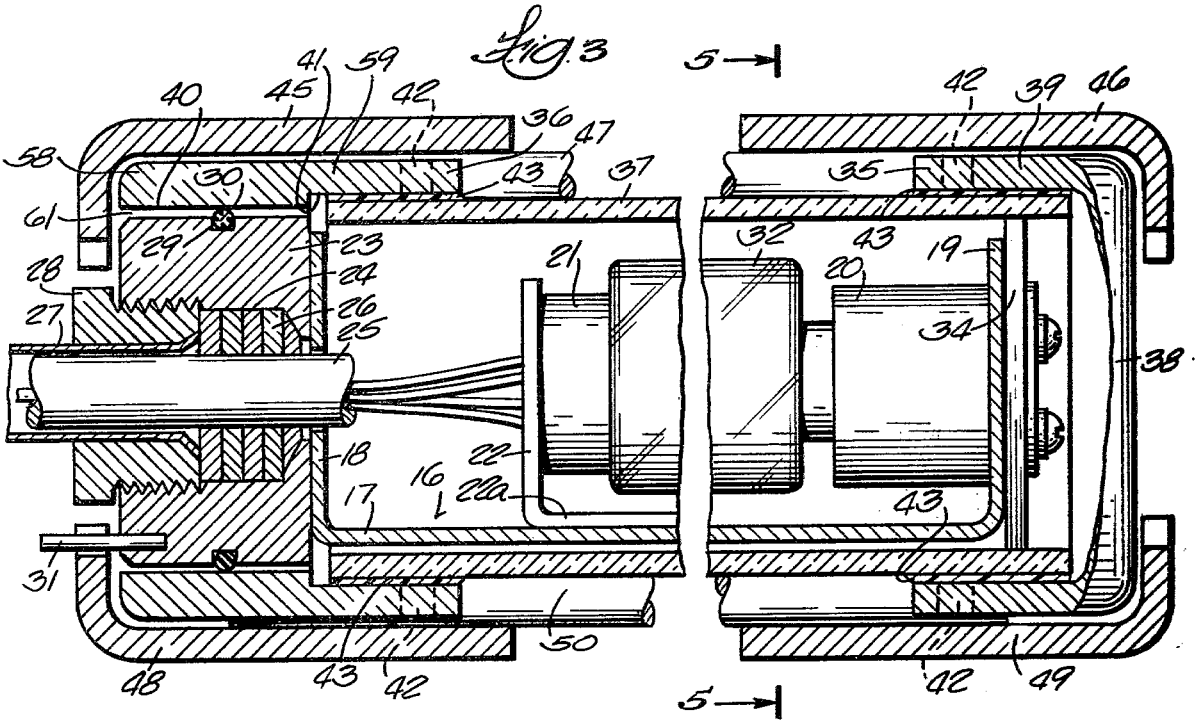
FIG. 3 is a longitudinal sectional view of the light fixture of FIG. 1.

Referring to FIGS. 2 and 3, the lamp assembly 11 includes a longitudinal support member 16 which has a long axial portion 17 and upstanding flanges 18 and 19 at its opposite ends. Lamp socket 20 is secured to the flange 19, and lamp socket 21 is secured to an L-shaped bracket 22 whose lower leg **22*a* is attached to the axial portion 17** of the support member.

The flange 18 of the support member 16 is attached to an end plug 23, shown as being of circular cross section with a central aperture 24. A multiple lead power cord 25 extends through the central aperture of the end plug 23 and its leads are connected to lamp sockets 20 and 21 in the conventional manner; the support member 16 may act as a grounding bar as is typical. A compressible packing gland 26 is inserted in the central aperture of the end plug 23 and extends about the power cord 25 to seal the aperture. A short metal tube 27 (see also FIG. 4) extends partway into the central aperture and serves as a protective element for the section of the power cord which passes through the end plug. A hollow plug 28 is threaded into the central aperture as shown to secure the power cord in place and complete the sealing of the aperture. Set screw 33 is threaded into the end plug 23 in a suitable position to keep the hollow plug 28 from rotating and being inadvertently removed from the end plug.

A circumferential groove 29 extends about the end plug 23 and an O-ring gasket 30 is positioned in the groove. Locating pin 31 is attached to the outer end surface of the end plug and extends in an axial direction, for the purpose to be discussed below.

A fluorescent lamp 32 is inserted in the lamp sockets 20 and 21 in the usual manner. As best shown in FIG. 2, the various elements which make up the lamp assembly 11 are carried on the support member 16, so that the lamp assembly comprises an integral unit which can be readily inserted into the fixture and removed from it when it is necessary to change the lamp 32.

The fluorescent lamp 32 is illustrated in the drawings as being of the high wattage type and its ballast and starter would be in a separate box located outside the light fixture. However, if a low wattage fluorescent lamp is used in the fixture, its starter and ballast can be mounted on the support member 16 and thereby positioned within the light fixture. Other lamps may also be used in the light fixture 10, including quartz lamps and incandescent lamps; when such lamps are used, their associated socket(s) are to be mounted on the support member 16.

Figure 5:
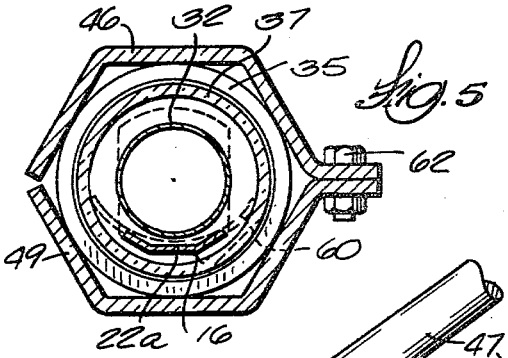
FIG. 5 is a vertical sectional view of the light fixture taken along the plane of line 5–5 of FIG. 3.

The lamp 32 is also illustrated as being of the type which has a built-in reflector. If the lamp does not include this feature, a separate reflector 60 may be attached to the support member 16 as shown in dashed lines in the sectional view of FIG. 5. The reflector will extend axially along the support member and it should be of the appropriate length required for the particular lamp used in the fixture.

Housing

The housing 12, referring again to FIG. 3, includes a closed end cap 35, an open end cap 36 and a light-transmitting element shown as a tube 37. The closed end cap 35 is a cup-like member including an end wall 38 and an axial wall 39 which overlies an end portion of the tube 37. The tube 37 may be transparent or translucent a desired, and should be of sufficient length and diameter to enclose the particular lamp used in the light fixture 10. The open end cap 36 is a hollow ring-like member having an end wall 58 and an axial wall 59 overlying an end portion of the tube 37, with an axial central bore 40 extending from the end wall through the end cap. The central bore 40 has an enlarged inner portion 41 that faces the closed end cap 35 and within which the end portion of the tube 37 is received. As indicated in the drawing, the central bore 40 of end cap 36 is large enough to receive the end plug 23 of the lamp assembly.

The outer surface of the end portions of the tube 37 which are enclosed by the end caps 35 and 36 are smooth or edentate instead of being machined, such as by being threaded. Further, the tube 37 is of uniform diameter throughout its length; thus, it may be used as purchased from the tubing manufacturer without machining to form threads or reduce the diameter at the ends of the tube. As best seen in FIG. 2, a plurality of holes 42 are formed about the periphery of the portions of end caps 35 and 36 which surround the tube 37. Each hole 42 communicates with the space between an end cap and an adjacent end portion of the tube 37 in the manner illustrated in FIG. 3. After the end caps and the tube are assembled, sealing material 43 is injected through the holes 42 to join the tube to each end cap. This procedure eliminates the need to machine the ends of the tube 37, such as with threads, in order to attach it to the end caps. When the tube 37 is made of polycarbonate plastic, an effective sealing material has been found to be room temperature vulcanized silicone rubber. Other sealing materials may be used, such as molten plastic and natural or synthetic rubbers, and the specific sealing material to be selected will depend upon the types of materials used for the tube 37 and the end caps 35 and 36 as well as the assembly procedure which one desires to employ.

(c) Protective Cage

The construction of the protective cage 13 is best shown in FIG. 2. The first cage element 14 comprises a pair of spaced end members 45 and 46 and a pair of bars 47 having their opposite ends attached to the end members to form half of a cage-like enclosure. The second cage element 15 is of similar construction, comprising spaced end members 48 and 49 with bars 50 extending therebetween. The end members and bars of the two elements are illustrated as being made of metal and the bars are welded to the end members to form the desired structure.

The end members 45, 46 and 48, 49 are each of the same structure but of opposite hand as necessary, and the following description refers to end member 49. Each end member is shown as having a generally U-shaped retainer wall 51. The retainer wall can have other configurations, such as curved or rectangular if so desired. A radial flange 52 extends from one edge of each retainer wall, and a notch 53 is formed in the outer edge of each radial flange 52. A wing 54 extends from an end of each retainer wall and an aperture 55 is formed in each wing 54.

Attachment lugs 56 and 57 are joined to the bars 50 of the second cage element 15 near each end member thereof. The lugs 56 and 57 are used for attaching the light fixture 10 to an object such as a machine or other support structure, as by bolts, welds, etc.

To assemble the several elements of the light fixture 10, the lamp assembly 11 is first inserted into the housing 12. The lamp assembly 11 slides into the housing 12 through the central bore 40 of the open end cap 36; this provides a slip-fit between these two elements as opposed to a threaded type of connection typically found in other light fixtures. Isolator pad 34 is attached to the flange 19 of the central support member 16 and snugly engages the inner surface of tube 37 when the lamp assembly is positioned in the housing; the isolator pad is made of resilient material, such as rubber, and centers one end of the lamp assembly in the housing and provides protection against shock and vibration. The end plug 23 of the lamp assembly fits within the central bore 40 of the open end cap 36 of the housing and is slightly therefrom by a circumferential zone 61 (see FIG. 3). The circumferential zone 61 defines a flame path of any selected length, and may for example be of a length sufficient to comply with the Schedule 2G requirements. As shown in FIG. 3, the outside diameter of end plug 23 is larger than the inside diameter of tube 37 so that the end plug cannot be forced into the tube, to thereby maintain the length of the flame path. The gasket 30 between the end plug 23 and end cap 36 provides a seal against dirt and moisture between these two elements.

Figure 4:
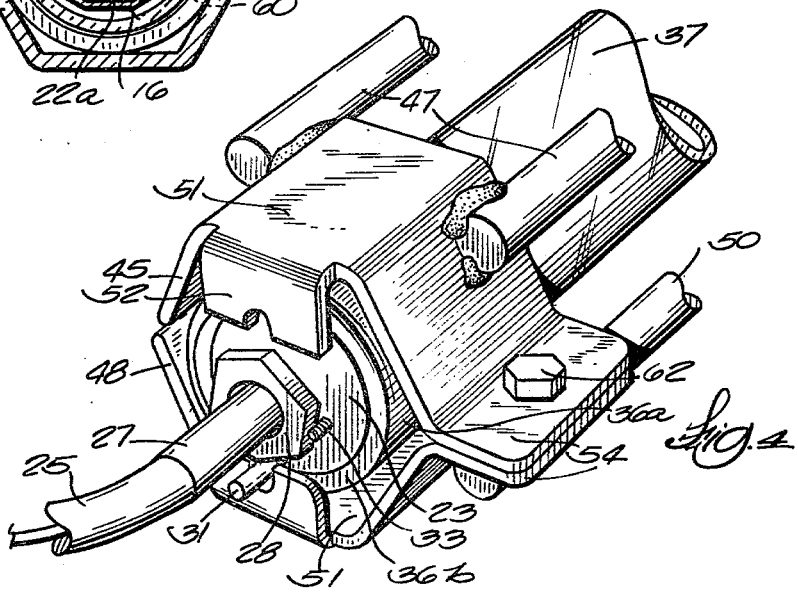
FIG. 4 is a perspective view of a portion of the light fixture.

The first and second cage elements 14 and 15 of the protective cage are each then positioned about the housing 12. The retainer wall 51 of each end member of the cage elements bears against the outer axial of circumferential surface of its adjacent end cap of the housing, as exemplified by surface **36*a* as shown in FIG. 4. The radial flange 52 of each end member of the cage elements bears against the end surface of its adjacent end cap of the housing 12 and the radial flanges 52 of end members 45 and 48 extend far enough to also bear against end plug 23 which is positioned within open end cap 36, see e.g. end surface 36*b* and end plug 23 in FIG. 4. Thus the end members of the protective cage elements hold the housing 12 within the protective cage 13. When the cage elements 14 and 15 are properly positioned, the wings 54 of adjacent end members 45, 48 and 46, 49 are generally superimposed with one another and connector means, such as bolts 62, may be inserted through aligned apertures 55 to join the two cage elements together and form the protective cage 13. The locator pin 31 attached to end plug 23 fits into a notch 53 of an end member of a cage element ot ensure that the housing 12 will be properly oriented in the protective cage. If desired, additional holes for the locator pin 31 can be provided in the end plug 23** so that the pin can be placed in various positions to permit adjustment of the aiming of the housing and lamp assembly.

The lamp fixture 10 as described above incorporates a number of unique advantages in a fixture of this type. Firstly, the protective cage 13 is formed of two elements that are readily joined together to form the completed enclosure and yet they can be easily separated from one another. This enables the cage to be removed quickly, even when one of the elements is attached to a machine, when it is necessary to insert new lamps in the fixture or perform other maintenance work. At the same time, the enclosure affords suitable protection against physical damage to the more fragile elements of the fixture. Secondly, the housing 12 has an open end and a closed end, and the lamp assembly 11 has a slip-fit engagement with the open end of the housing. Most fixtures of this type known to us have employed a threaded connection between such elements which requires that one element be rotated with respect to the other in order to effect disengagement. However, with our new fixture, the user can merely slide the lamp assembly in and out of the housing 12 through the open end thereof. This feature also provides for rapid disassembly of the fixture when relamping is necessary. (While our new protective cage is most effective when employed with a lamp assembly of this type, the cage itself also may be used with other fixtures which utilize a threaded connection between a lamp assembly and a surrounding housing element.) Thirdly, the outer surface of the end portions of the tube 37 which are received in the end caps 35 and 36 are edentate, or smooth, instead of being machined to have threads as is the customary technique. This facilitates the use of materials for the tube which can be difficult to machine, such as polycarbonate plastics, so as to thereby eliminate potentially expensive manufacturing step, and it also permits the use of lighter weight materials for the tube. Other advantages of our new light fixture appear in the preceding detailed description of the construction of the preferred embodiments illustrated herein.

We have found that the electric light fixture of our present invention can be relamped in considerably less time than other fixture designs of which we are aware. Thus, when the lamp inside the fixture needs to be replaced, the fixture can be disassembled, a new lamp inserted in the lamp assembly, and the elements reassembled in about one minute. Other designs often require as much as ten minutes for a user to disassemble sufficiently to enable replacement of the lamp. This is believed to be a significant feature insofar as it not only reduces the manpower cost of relamping but also has a safety advantage in that a burned-out lamp need be out of service for only a short period of time.

A light fixture has thus been provided which can meet federal regulations relating to an explosion-proof fixture suitable for use in underground mines, such as those of Schedule 2G referred to earlier in this description. The fixture also may be used in other environments in which such characteristics are not required, however, and various of its design features can be adjusted as appropriate.

We claim:

1. An electric light fixture comprising, in combination:

(1) a lamp assembly, (2) a housing surrounding the lamp assembly and including a light-transmitting element joined to a pair of spaced end caps, each end cap having an end wall and an axial wall; and (3) a protective cage positioned about the outside of the housing and including first and second cage elements, said first and second cage elements each comprising a pair of spaced end members and bars connected therebetween, wherein each end member of each cage element has:

(a) a retainer wall extending partially about an axial wall of an end cap of the housing, (b) a radial flange attached to the retainer wall and extending about an end wall of an end cap of the housing, and (c) a wing extending from the retainer wall; and (4) connector means between superimposed wings of adjacent end members to join the cage elements into a cagelike enclosure about the outside of the housing.

2. An electric light fixture according to claim 1, wherein:

the retainer wall of the end member of each cage element is generally U-shaped.

3. An electric light fixture according to claim 1, further including:

attachment lugs joined to one of the cage elements for attachment of the fixture to an object.

4. An electric light fixture according to claim 1, wherein:

the housing includes one open end cap and one closed end cap, and the lamp assembly is insertible therein through the open end cap.

5. An electric light fixture comprising, in combination:

(1) a lamp assembly comprising an end plug, a support member attached to the end plug, and a lamp carried on the support member;

(2) a housing comprising spaced first and second end caps and a light-transmitting element joined to said end caps and extending therebetween, the first end cap including an end wall, an axial wall projecting from the end wall and overlying an end portion of the light-transmitting element, and an axial bore extending from the end wall through the end cap;

the second end cap including a fixed end wall which closes one end of the housing, and an axial wall projecting from the end wall and overlying an end portion of the light-transmitting element, the lamp assembly being enclosed by the housing with its end plug positioned within the axial bore of the first end cap of the housing in slip-fit engagement therewith, the lamp assembly being slidable into and out of the housing through said axial bore for replacement of the lamp carried on the support member; and (3) a protective cage positioned about the housing.

6. An electric light fixture comprising, in combination:

(1) a lamp assembly comprising an end plug, a support member attached to and extending from the end plug, and a lamp carried on the support member;

(2) a housing comprising spaced first and second end caps and a light-transmitting element joined to said end caps, the first end cap including an end wall, an axial wall projecting from the end wall and overlying an end portion of the light-transmitting element, and an axial bore extending from the end wall through the end cap, the second end cap including an end wall which closes one end of the housing and an axial wall projecting from the end wall and overlying an end portion of the light-transmitting element, the lamp assembly being enclosed by the housing with its end plug positioned within the axial bore of the first end cap of the housing in slip-fit engagement therewith;

(3) a protective cage positioned about the outside of the housing and including first and second cage elements, said first and second cage elements each comprising a pair of spaced end members and bars connected therebetween, each end member of each cage element having (a) a retainer wall extending partially about the axial wall of an end cap of the housing, (b) a radial flange attached to the retainer wall and extending along the end wall of an end cap of the housing, and (c) a wing extending from the retainer wall, and (4) connector means between superimposed wings of adjacent end members to join the cage elements into a cage-like enclosure about the housing.

7. An electric light fixture according to claim 5 or 6, wherein:

the axial walls of the first and second end caps of the housing overlying end portions of the light-transmitting element are spaced therefrom, said end portions of the light-transmitting element are edentate, and sealing material joins each end cap to its adjacent edentate end portion of the light-transmitting element along the space therebetween.

8. An electric light fixture according to claim 6, further including:

a locator pin extending from the end plug of the lamp assembly, and the radial flange of an end member of the housing including a notch in which the locator pin is received to thereby orient the lamp assembly with respect to the protective cage.

* * * * *

UNITED STATES PATENT AND TRADEMARK OFFICE

CERTIFICATE OF CORRECTION

PATENT NO. : 4,264,946

DATED : April 28, 1981

INVENTOR(S) : Kenneth R. Faux, Sr. and Donald J. Zach

It is certified that error appears in the above—identified patent and that said Letters Patent is hereby corrected as shown below:

Delete the drawing appearing on the first page of the patent and substitute Fig. 1 therefor.

Column 2, line 23, "of" first occurrence should be -- to --
Column 3, line 24, "a" should be -- as --;
Column 4, line 52, "of" should be -- or --;
Column 5, line 2, "ot" should be -- to --; and
Column 5, line 42, add -- a -- before "potentially".

Signed and Sealed this

Thirtieth Day of June 1981

[SEAL]

Attest:

RENE D. TEGTMEYER

Attesting Officer

Acting Commissioner of Patents and Trademarks